US010670311B2

(12) United States Patent
Matsumura et al.

(10) Patent No.: US 10,670,311 B2
(45) Date of Patent: Jun. 2, 2020

(54) HEAT EXCHANGER

(71) Applicant: Johnson Controls-Hitachi Air Conditioning Technology (Hong Kong) Limited, Hong Kong (CN)

(72) Inventors: Kenji Matsumura, Tokyo (JP); Kazumoto Urata, Tokyo (JP); Koji Naito, Tokyo (JP); Mikihito Tokudi, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 127 days.

(21) Appl. No.: 15/164,965

(22) Filed: May 26, 2016

(65) Prior Publication Data

US 2016/0348951 A1 Dec. 1, 2016

(30) Foreign Application Priority Data

May 29, 2015 (JP) ..... 2015-109324

(51) Int. Cl.
*F25B 39/00* (2006.01)
*F25B 13/00* (2006.01)
(Continued)

(52) U.S. Cl.
CPC ..... *F25B 39/00* (2013.01); *F25B 13/00* (2013.01); *F28D 1/0475* (2013.01); *F28F 1/32* (2013.01);
(Continued)

(58) Field of Classification Search
CPC ..... F25B 39/00; F25B 13/00; F25B 2500/01; F25B 41/00; F25B 41/003; F28D 1/0475;
(Continued)

(56) References Cited

U.S. PATENT DOCUMENTS 3,866,439 A * 2/1975 Bussjager ..... F25B 39/02 62/504
4,123,919 A * 11/1978 Fehlhaber ..... F25B 5/02 62/503
(Continued)

FOREIGN PATENT DOCUMENTS

CN 1590924 A 3/2005
CN 1696581 A 11/2005
(Continued)

OTHER PUBLICATIONS

Chinese Office Action received in corresponding Chinese Application No. 201610375157.1 dated May 4, 2018.
(Continued)

*Primary Examiner* — Tho V Duong
*Assistant Examiner* — Raheena R Malik
(74) *Attorney, Agent, or Firm* — Mattingly & Malur, PC

(57) ABSTRACT

The present invention provides a heat exchanger having a heat exchanging portion HE including a plurality of paths through which a refrigerant flows and a plurality of columns of fin plate that exchange heat between the refrigerant and air, wherein, in a case where the heat exchanging portion functions as a condenser, the refrigerant is flown from a header into the heat exchanging portion HE via the plurality of paths, every two paths of the plurality of paths merge into one single path by branching/merging pipes after the refrigerant has flown through one fin plate, before the refrigerant flows through the other fin plate so as to flow out of the heat exchanging portion HE, wherein a difference in height between the highest path and the lowest path in a vertical direction is set equal to or less than half of a height of the heat exchanging portion HE.

8 Claims, 11 Drawing Sheets

(51) Int. Cl.

| | |
|---|---|
| ***F28D 1/047*** | (2006.01) |
| ***F28F 13/06*** | (2006.01) |
| ***F28F 1/32*** | (2006.01) |
| *F28D 21/00* | (2006.01) |

(52) U.S. Cl.
CPC ..... *F28F 13/06* (2013.01); *F25B 2500/01* (2013.01); *F28D 2021/007* (2013.01); *F28D 2021/0071* (2013.01)

(58) Field of Classification Search
CPC ..... F28D 2021/007; F28D 2021/0071; F28F 1/32; F28F 13/06
USPC ..... 165/167; 62/324.6
See application file for complete search history.

(56) References Cited

U.S. PATENT DOCUMENTS 4,407,137 A * 10/1983 Hayes, Jr. ..... F25B 13/00 62/151
5,076,353 A * 12/1991 Haussmann ..... F25B 39/04 165/110
5,529,116 A * 6/1996 Sasaki ..... F28D 1/0417 123/41.51
5,937,669 A * 8/1999 Okuri ..... F25B 6/04 62/114
6,382,310 B1 * 5/2002 Smith ..... F28B 1/06 165/121
7,171,817 B2 * 2/2007 Birgen ..... F25B 13/00 62/140
9,528,769 B2 * 12/2016 Sakashita ..... F24F 1/0007
9,885,525 B2 * 2/2018 Yokozeki ..... F28F 9/0275
10,309,701 B2 * 6/2019 Morimoto ..... F25B 39/00
10,422,566 B2 * 9/2019 Hokazono ..... F25B 41/003
2005/0044882 A1 3/2005 Hong et al.
2005/0284174 A1 * 12/2005 Nakajima ..... F25B 13/00 62/513
2006/0168998 A1 * 8/2006 Chin ..... F24F 1/0059 62/515
2006/0185385 A1 8/2006 Feldhaus et al.
2010/0089556 A1 * 4/2010 Yang ..... F28D 1/0477 165/145
2010/0170270 A1 * 7/2010 Jang ..... F25B 13/00 62/81
2011/0041541 A1 * 2/2011 Yoon ..... F24F 1/32 62/324.5
2012/0073786 A1 * 3/2012 Sakashita ..... F24F 1/0007 165/104.14
2013/0306285 A1 11/2013 Jindou et al.
2015/0204592 A1 * 7/2015 Iwasaki ..... F24F 11/006 62/156
2015/0211802 A1 * 7/2015 Yokozeki ..... F28F 9/0275 165/104.14
2016/0033179 A1 * 2/2016 Kim ..... F25B 13/00 62/324.6
2016/0187049 A1 6/2016 Hokazono et al.
2017/0234587 A1 * 8/2017 Jindou ..... F25B 39/00 62/527
2017/0328614 A1 * 11/2017 Yokozeki ..... F25B 39/00

FOREIGN PATENT DOCUMENTS

| | | | |
|---|---|---|---|
| EP | 2 031 334 | A1 | 3/2009 |
| JP | 2001-66017 | A | 3/2001 |
| JP | 2003-130496 | A | 5/2003 |
| JP | 2006-214714 | A | 8/2006 |
| JP | 3847121 | B2 | 11/2006 |
| JP | 2009-287837 | A | 12/2009 |
| JP | 2012-163319 | A | 8/2012 |
| WO | 2007/139137 | A1 | 12/2007 |
| WO | 2014/199501 | A1 | 12/2014 |

OTHER PUBLICATIONS

Japanese Office Action received in corresponding Japanese Application No. 2015-109324 dated Feb. 12, 2019.

* cited by examiner

HEAT EXCHANGER

BACKGROUND OF THE INVENTION

Field of the Invention

This application claims the benefit of priority to Japanese Patent Application No. 2015-109324, filed on May 29, 2015, the disclosures of all of which are hereby incorporated by reference in their entities.

The present invention relates to a heat exchanger having a plurality of refrigerant paths.

Description of the Related Arts

In recent years, problems such as energy exhaustion and global warning have been drawing attention and air conditioners and refrigerators are desired to have a highly efficient refrigeration cycle. A heat exchanger as one of the structure elements for a refrigeration cycle has much influence on refrigeration cycle performance and has been improved for higher performance. Especially, in recent years, it has been known that performance improvement for a low load greatly contributes to annual saving energy, to encourage new techniques to be developed for that. Since a refrigerant does not flow much for a low load, a liquefied refrigerant in a condenser having multiple paths is influenced by gravity to make the refrigerant flow less easily in a lower path than in an upper path, causing performance degradation. For example, in Japanese Patent Application Publication No. 2003-130496, a heat exchanger having only two paths is used as a condenser to have a structure, in which a liquid refrigerant does not stagnate in a lower part of the heat exchanger, for improving performance.

SUMMARY OF THE INVENTION

Problems to be Solved by the Invention

Heat transfer pipes used in the heat exchanger are normally formed as thin pipes and are configured in multiple paths on the purpose of decreasing flow resistance of the refrigerant, so that respective paths run to-and-fro in the heat exchanger. In the case where the heat exchanger is used as a condenser, the refrigerant flows into the heat exchanger as gas having low density and flows out of the heat exchanger as liquid having high density, to make the refrigerant in a lower path in the gravity direction flow less easily under influence by gravity.

FIGS. 11A to 11C are charts for illustrating how the gravity influences on a refrigerant flow rate. As shown in FIG. 11A, a vapor refrigerant (gas refrigerant) is flown through five paths to a heat exchanger, to allow each path running to-and-fro in the heat exchanger to exchange heat with air flown by a blower so as to be liquefied (condensed), and is flown out of the heat exchanger as a liquid state or a substantially liquid state for merging. Pressure in each path is influenced by a pressure drop (pressure change) due to the flow and by a head due to gravity. Therefore, the refrigerant can flow more easily in the upper path and less easily in the lower path due to gravity.

FIG. 11B is a schematic chart showing pressure change in the upper and lower paths when the refrigerant flow rate is relatively large for achieving required performance as the heat exchanger (at a high flow rate). In FIG. 11B, the pressure drop due to the flow is shown at the left and the influence due to gravity is shown at the right. Inlets and outlets of paths are connected in one line, to make the upper and lower paths have the same pressure respectively at the inlets and outlets for the refrigerant. In this case, a flow rate distribution to each path is determined by flow resistance, which is influenced by gravity, but the influence by the flow resistance is generally dominant to have small influence by gravity.

On the other hand, FIG. 11C is a schematic chart showing the pressure change in the upper and lower paths at a low flow rate. In this case, the flow resistance is small naturally (the straight line in FIG. 11C less inclines), and the influence by gravity is substantially determined by the position (height) where each path is arranged, to cause no difference due to the flow rate. Consequently, the refrigerant flows less easily in the lower path because of no flow resistance against the gravity, and may not flow at all depending on a condition.

It should be noted that FIG. 11A shows a case where a merging unit P1 on a liquid side (outlet side) is arranged at the center in an up-down direction of the heat exchanger, but the position of the merging unit 1 is not essential because the influence is caused by a relative position of the upper and lower paths. In other words, the influence by gravity cannot be corrected even if the merging unit P1 is arranged at an upper side or a lower side. In such a condition, the heat exchanger cannot be used properly and the refrigerant in the lower path is quickly liquefied as soon as it flows into the heat exchanger to cause the refrigerant to stagnate in the heat exchanger, reducing the efficiency of the heat exchanger due to refrigerant shortage in the entire refrigeration cycle.

In an attempt to solve the problem above, Japanese Patent Application Publication No. 2003-130496 discloses a structure in which only two paths are used to prevent the refrigerant from stagnating in the lower path. However, if the number of paths is increased, the structure cannot overcome the problem above.

The present invention provides a heat exchanger which can solve the conventional problem as described above, can reduce influence by gravity, and can reduce flow resistance.

Means for Solving Problems

An aspect of the present invention provides a heat exchanger having: a heat exchanging portion including a plurality of paths through which a refrigerant flows and a plurality of columns of fin plate that exchange heat between the refrigerant and air, wherein, on the condition that the heat exchanging portion functions as a condenser, the refrigerant is flown from a header into the heat exchanging portion via the plurality of paths, every two paths of the plurality of paths merge into a single path after the refrigerant has flown through at least one column of fin plate, before the refrigerant flows through the other column of fin plate so as to flow out of the heat exchanging portion, and a difference in height, among the plurality of paths exiting the heat exchanging portion, between the highest path and the lowest path in a vertical direction is set equal to or less than half of a height of the heat exchanging portion.

Effect of the Present Invention

The present invention can provide a heat exchanger which can reduce influence by gravity and flow resistance.

DETAILED DESCRIPTION OF THE PREFERRED EMBODIMENTS

Figure 1:
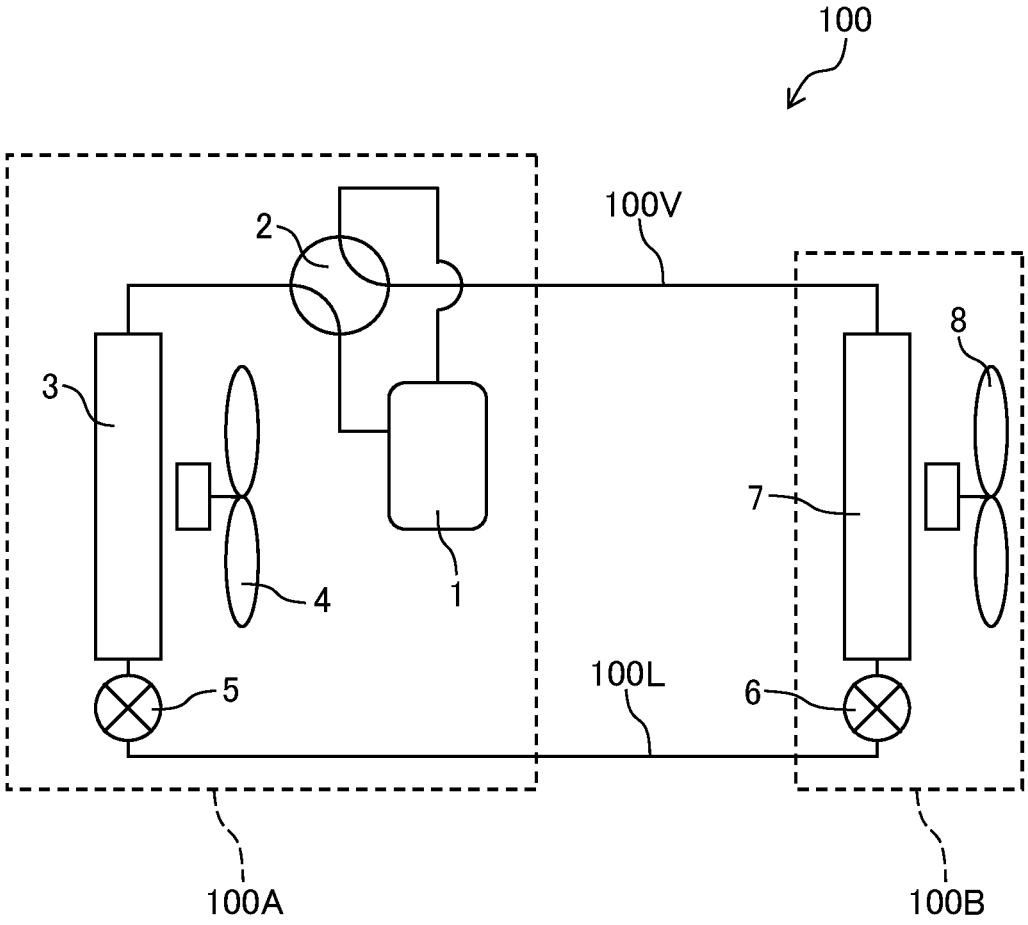
FIG. 1 is a structure diagram showing a refrigeration cycle of a typical air conditioner.

A description will be given of the present invention in detail with reference to drawings appropriately. In a case where a refrigeration cycle is referred to without any special notice, it refers to a refrigeration cycle usable for cooling, heating or both of them. In addition, the purpose of illustration, common members in respective drawings are marked with the same reference numerals and duplicate descriptions thereof are omitted. Axes of a front-direction, a back-direction, an up-down direction and a right-left direction are based on descriptions in each drawing.

FIG. 1 is a structure diagram of a refrigeration cycle of a typical air conditioner.

As shown in FIG. 1, an air conditioner 100 has an outdoor unit 100A, an indoor unit 100B, and pipes 100L, 100V which connect the outdoor unit 100A and the indoor unit 100B. The outdoor unit 100A includes a compressor 1, a four-way switching valve 2 which switches flow directions of a refrigerant for cooling or heating, a heat exchanger 3 of a fin tube type, a blower 4 which supplies air to the heat exchanger 3 and an outdoor unit decompressor 5. The indoor unit 100B includes an indoor unit decompressor 6, a heat exchanger 7 of a fin tube type, and a blower 8 which supplies air to the heat exchanger 7.

A refrigerant in a liquid state or a substantially liquid state flows through the pipe 100L and the refrigerant in a gas state or a substantially gas state flows through the pipe 100V. Once the four-way switching valve 2 is switched, the heat exchanger 3 in the outdoor unit 100A and the heat exchanger 7 in the indoor unit 100B switch the functions between a condenser and an evaporator.

First Embodiment

Figure 2:
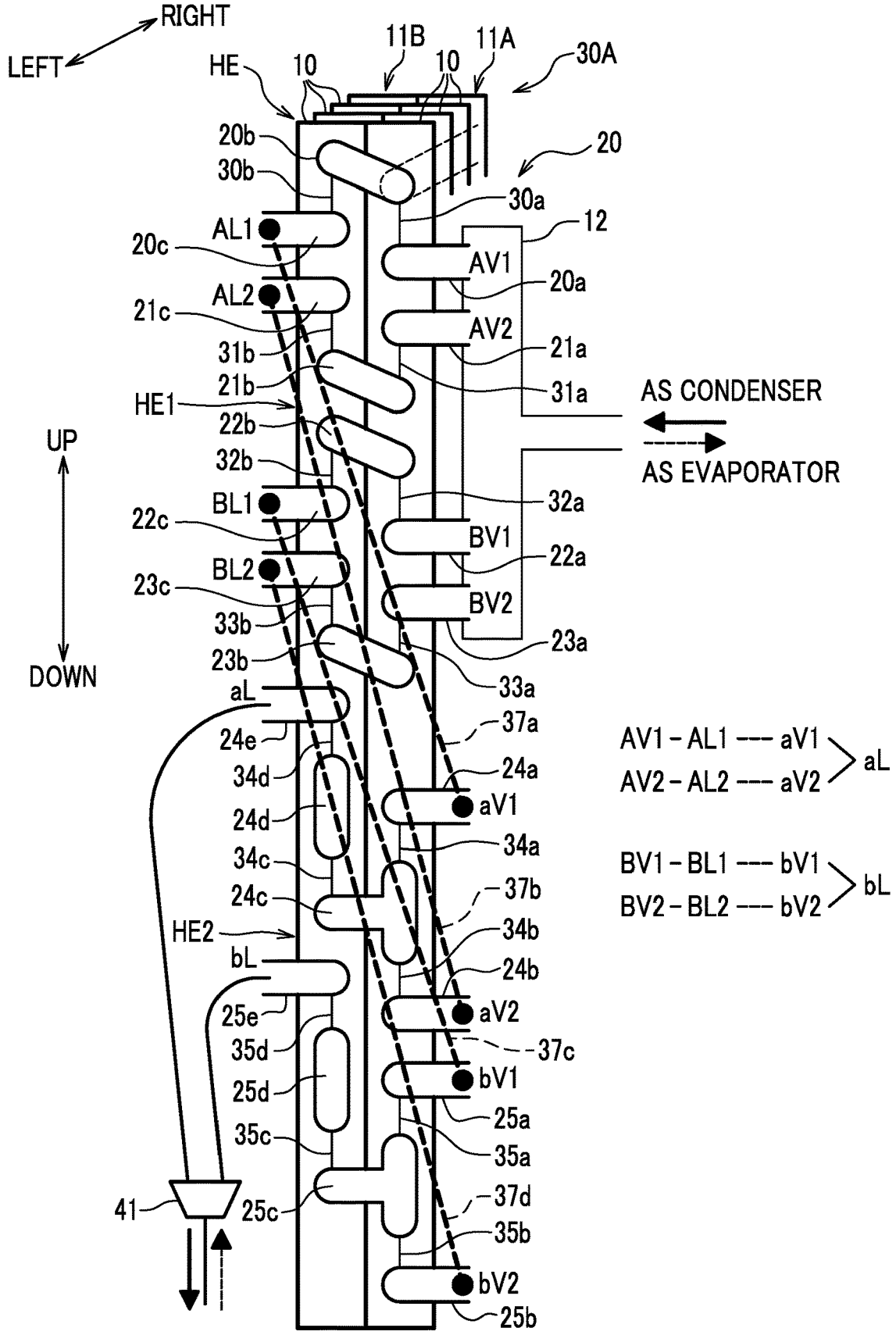
FIG. 2 is a flow diagram of a refrigerant in a heat exchanger of a first embodiment.

FIG. 2 is a flow diagram of the refrigerant in the heat exchanger of the first embodiment according to the present invention. It should be noted that a description will be given of a heat exchanger 30A (3) arranged in the outdoor unit 100A, but can be applied to the heat exchanger 7 in the indoor unit 100B. In FIG. 2, only one end of the heat exchanger 30A in the right-left direction is shown. Further, the solid arrow in FIG. 2 indicates a flow direction of the refrigerant when the heat exchanger 30A functions as a condenser, while the broken arrow indicates a flow direction of the refrigerant when the heat exchanger 30A functions as an evaporator.

As shown in FIG. 2, the heat exchanger 30A is, for example, of a cross fin tube type, and is configured to include fin plates 11A, 11B, each having a plurality of fins 10 made of aluminum stacked in a thickness direction, and a refrigerant pipe 20.

The fin plates 11A, 11B are arranged in two columns (multiple columns) in a air-flow direction. It should be noted that the fin plates may not be limited to be arranged in two columns but may be arranged in three or more columns.

The refrigerant pipe 20 constitutes a flow path through which the refrigerant flows and penetrates respective fins 10 of the fin plates 11A, 11B. It should be noted that the refrigerant pipe 20 extends substantially in the horizontal direction (a direction perpendicular to the vertical direction, which is the right-left direction in FIG. 1), and is arranged so as to meander (run to-and-fro) in the fin plates 11A, 11B.

In addition, the refrigerant pipe 20 has a header 12 connected with four heat transfer pipes 20*a*, 21*a*, 22*a*, 23*a*, and is connected to one end (left end in the figure) of the fin plate 11A. It should be noted that the header 12 functions as a distributor when the heat exchanger 30 functions as a condenser, and functions as a merging device when the heat exchanger 30 functions as an evaporator.

The heat transfer pipe 20*a* penetrates the fin plate 11A from one end to the other end (one column of fin plates) to connect to one end of a return bend 30*a* (U-shaped pipe) at the other end of the fin plate 11A. It should be noted that the return bend 30*a* is arranged on the other end side of the fin plate 11A, for the purpose of illustration, is indicated by a thin solid line and is not shown in detail (other return bends are shown likewise). Above the heat transfer pipe 20*a*, a heat transfer pipe 20*b* is arranged so as to cross over the fin plates 11A, 11B, and one end of the heat transfer pipe 20*b* is connected to the other end of the return bend 30*a*. The other end of the heat transfer pipe 20*b* is connected to one end of a return bend 30*b* at the other end (right end in FIG. 2) of the fin plate 11B (the other column of fin plates). Below the heat transfer pipe 20*b*, a heat transfer pipe 20*c* is arranged to penetrate the fin plate 11B from one end to the other end, and the heat transfer pipe 20*c* is connected to the other end of the return bend 30*b*. It should be noted that the return bend 30 and the like may be U-shaped heat transfer pipes and a heat transfer pipe 24*d* and the like to be described later may be return bends so as not to have joints (bends) on the rear side (deep side in the drawing) in FIG. 2.

The heat transfer pipe 21*a* penetrates the fin plate 11A from one end to the other end to connect to one end of a return bend 31*a*. Below the heat transfer pipe 21*a*, a heat transfer pipe 21*b* is arranged so as to cross over the fin plates 11A, 11B, and one end of the heat transfer pipe 21*b* is connected to the other end of a return bend 31*b*. The other end of the heat transfer pipe 21*b* is connected to one end of the return bend 31*b* at the other end of the fin plate 11B. Above the heat transfer pipe 21*b*, a heat transfer pipe 21*c* is arranged to penetrate the fin plate 11B from one end to the other end, and the heat transfer pipe 21*c* is connected to the other end of the return bend 31*b*.

The heat transfer pipe 22*a* penetrates the fin plate 11A from one end to the other end to connect to one end of a return bend 32*a*. Above the heat transfer pipe 22*a*, a heat transfer pipe 22*b* is arranged so as to cross over the fin plates 11A, 11B, and one end of the heat transfer pipe 22*b* is connected to the other end of the return bend 32*a*. The other end of the heat transfer pipe 22*b* is connected to one end of the return bend 32*b* at the other end of the fin plate 11B. Below the heat transfer pipe 22*b*, a heat transfer pipe 22*c* is arranged so as to penetrate the fin plate 11B from one end to the other end, and the heat transfer pipe 22*c* is connected to the other end of the return bend 32*b*.

The heat transfer pipe 23*a* penetrates the fin plate 11A from one end to the other end to connect to one end of a return bend 33*a*. Below the heat transfer pipe 23*a*, a heat transfer pipe 23*b* is arranged to cross over the fin plates 11A, 11B, and one end of the heat transfer pipe 23*b* is connected to the other end of the return bend 33*a*. The other end of the heat transfer pipe 23*b* is connected to one end of the return bend 33*b* at the other end of the fin plate 11B. Above the heat transfer pipe 23*b*, a heat transfer pipe 23*c* is arranged to penetrate the fin plate 11B from one end to the other end, and the heat transfer pipe 23*c* is connected to the other end of the return bend 33*b*.

Thus, the heat exchanger 30A is configured to have four paths (a plurality of paths) via the header 12. In the heat exchanger 30A, the heat transfer pipes 20*a* to 20*c* are positioned at the top, the heat transfer pipes 21*a* to 21*c* are positioned below the heat transfer pipes 20*a* to 20*c*, the heat transfer pipes 22*a* to 22*c* are positioned below the heat transfer pipes 21*a* to 21*c*, and the heat transfer pipes 23*a* to 23*c* are positioned below the heat transfer pipes 22*a* to 22*c*. It should be noted that the number of paths shown in FIG. 2 is just one example and may be more than four, without being limited by this embodiment.

Further, the heat exchanger 30A has heat transfer pipes 24*a*, 24*b*, a branching/merging pipe 24*c*, heat transfer pipes, 24*d*, 24*e*, heat transfer pipes 25*a*, 25*b*, a branching/merging pipe 25*c*, heat transfer pipes 25*d*, 25*e* below the heat transfer pipes 23*a* to 23*c*.

The heat transfer pipe 24*a* penetrates the fin plate 11A from one end to the other end to connect to one end of the return bend 34*a*. The heat transfer pipe 24*b* is positioned below the heat transfer pipe 24*a*, penetrates the fin plate 11A from one end to the other end to connect to one end of the return bend 34*b*.

The branching/merging pipe 24*c* has a three-forked shape, is positioned between the heat transfer pipe 24*a* and the heat transfer pipe 24*b*, and merges two paths into one path when the heat exchanger functions as a condenser. It should be noted that the branching/merging pipe 24*c* branches one path to two paths when the heat exchanger functions as an evaporator. Further, two pipes of the branching/merging pipe 24*c* penetrate the fin plate 11A from one end to the other end to connect to the other ends of the return bends 34*a*, 34*b*, respectively. The remaining one pipe of the branching/merging pipe 24*c* penetrates the fin plate 11B from one end to the other end to connect to one end of the return bend 34*c*.

Above the branching/merging pipe 24*c*, the heat transfer pipe 24*d* in a U-shape is arranged, penetrates the fin plate 11B from one end to the other end to connect to the other end of the return bend 34*c* and one end of the return bend 34*d*. Above the heat transfer pipe 24*d*, the heat transfer pipe 24*e* is arranged, penetrates the fin plate 11B from one end to the other end to connect to the other end of the return bend 34*d*. The heat transfer pipe 24*e* is connected to a branching/merging unit 41.

The heat transfer pipe 25*a* penetrates the fin plate 11A from one end to the other end to connect to one end of the return bend 35*a*. The heat transfer pipe 25*b* is positioned below the heat transfer pipe 25*a*, penetrates the fin plate 11A from one end to the other end to connect to one end of the return bend 35*b*.

The branching/merging pipe 25*c* has a three-forked shape, is positioned between the heat transfer pipe 25*a* and the heat transfer pipe 25*b*, and merges two paths in one path when the heat exchanger functions as a condenser. It should be noted that the branching/merging pipe 25*c* branches one path to two paths when the heat exchanger functions as an evaporator. Further, two pipes of the branching/merging pipe 25*c* penetrate the fin plate 11A from one end to the other end to connect to the other ends of the return bends 35*a*, 35*b*, respectively. The remaining one pipe of the branching/merging pipe 25*c* penetrates the fin plate 11B from one end to the other end to connect to one end of the return bend 35*c*.

Above the branching/merging pipe 25*c*, the heat transfer pipe 25*d* in a U-shape is arranged, penetrates the fin plate 11B from one end to the other end to connect to the other end of the return bend 35*c* and one end of the return bend 35*d*. Above the heat transfer pipe 25*d*, the heat transfer pipe 25*e* is arranged, penetrates the fin plate 11B from one end to the other end to connect to the other end of the return bend 35*d*. The heat transfer pipe 25*e* is connected to the branching/merging unit 41.

Outside the fin plates 11A, 11B, the heat transfer pipe 20*c* is connected to the heat transfer pipe 24*a* via a connecting pipe 37*a* (see the thick broken line in FIG. 2). Outside the fin plates 11A, 11B, the heat transfer pipe 21*c* is connected to the heat transfer pipe 24*b* via a connecting pipe 37*b* (see the thick broken line in FIG. 2). Outside the fin plates 11A, 11B, the heat transfer pipe 22*c* is connected to the heat transfer pipe 25*a* via a connecting pipe 37*c* (see the thick broken line in FIG. 2). Outside the fin plates 11A, 11B, the heat transfer pipe 23*c* is connected to the heat transfer pipe 25*b* via a connecting pipe 37*d* (see the thick broken line in FIG. 2). Thus, the connecting pipes 37*a* to 37*d* are connected while keeping the order in height in the vertical direction (up-down direction). In other words, the highest heat transfer pipe 20*c* in the vertical direction among the heat transfer pipes 20*c*, 21*c*, 22*c*, 23*c* on the fin plate 11B side is connected to the highest heat transfer pipe 24*a* in the vertical direction among the heat transfer pipes 24*a*, 24*b*, 25*a*, 25*b* on the fin plate 11A side. Similarly, the second highest heat transfer pipe 21*c* in the vertical direction is connected to the second highest heat transfer pipe 24*b*, the third highest heat transfer pipe 22*c* is connected to the third highest heat transfer pipe 25*a*, and the lowest heat transfer pipe 23*c* is connected to the lowest heat transfer pipe 25*b*.

Thus, in the heat exchanger 30A, a first path (AV1-AL1-aV1-aL) is formed by the heat transfer pipe 20*a*, the return bend 30*a*, the heat transfer pipe 20*b*, the return bend 30*b*, the heat transfer pipe 20*c*, the connecting pipe 37*a*, the heat transfer pipe 24*a*, the return bend 34*a*, the branching/merging pipe 24*c*, the return bend 34*c*, the heat transfer pipe 24*d*, the return bend 34*d* and the heat transfer pipe 24*e*. Further, in the heat exchanger 30A, a second path (AV2-AL2-aV2-aL) is formed by the heat transfer pipe 21*a*, the return bend 31*a*, the heat transfer pipe 21*b*, the return bend 31*b*, the heat transfer pipe 21*c*, the connecting pipe 37*b*, the heat transfer pipe 24*b*, the return bend 34*b*, the branching/merging pipe 24*c*, the return bend 34*c*, the heat transfer pipe 24*d*, the return bend 34*d* and the heat transfer pipe 24*e*. Still further, in the heat exchanger 30A, a third path (BV1-BL1-bV1-bL) is formed by the heat transfer pipe 22*a*, the return bend 32*a*, the heat transfer pipe 22*b*, the return bend 32*b*, the heat transfer pipe 22*c*, the connecting pipe 37*c*, the heat transfer pipe 25*a*, the return bend 35*a*, the branching/merging pipe 25*c*, the return bend 35*c*, the heat transfer pipe 25*d*, the return bend 35*d* and the heat transfer pipe 25*e*. Yet further, in the heat exchanger 30A, a fourth path (BV2-BL2-bV2-bL) is formed by the heat transfer pipe 23*a*, the return bend 33*a*, the heat transfer pipe 23*b*, the return bend 33*b*, the heat transfer pipe 23*c*, the connecting pipe 37*d*, the heat transfer pipe 25*b*, the return bend 35*b*, the branching/merging pipe 25*c*, the return bend 35*c*, the heat transfer pipe 25*d*, the return bend 35*d* and the heat transfer pipe 25*e*.

In the heat exchanger 30A, the fin plates 11A, 11B and portions contributing to heat exchange except heat transfer pipes protruding from both right and left ends of the fin plates 11A, 11B are referred to as a heat exchanging portion HE. Further, in the heat exchanging portion HE, a portion contributing to heat exchange at an upstream side of the connecting pipes 37*a*, 37*b*, 37*c* and 37*d* is referred to as an upper heat exchanging portion HE1 (upper side delimited by the thick broken line at the center in FIG. 3), and a portion contributing to heat exchange at a downstream side is referred to as a lower heat exchanging portion HE2 (lower side delimited by the thick broken line at the center in FIG. 3).

When the heat exchanger 30A constructed as above functions as a condenser, the gas refrigerant at high temperature flows to the upper portion (upper heat exchanging portion HE1) in the heat exchanger 30A for heat exchange. The refrigerant in respective paths flows to the lower portion (lower heat exchanging portion HE2) in the heat exchanger 30A. At the lower portion in the heat exchanger 30A, every two paths are merged. The refrigerant generates a phase change from gas to liquid and vice versa inside the heat exchanger 30A. Even if the gas has the same mass and flow rate as those of the liquid, density of the liquid is different from that of the gas, so that the flow rate of the gas is about 10 or more times faster than that of the liquid. As a result, in a region where the gas is dominant, efficiency is reduced by an increase of pressure loss due to an increase of the flow rate, while, in a region where the liquid is dominant, the efficiency is reduced by a decrease of heat transfer rate due to a decrease of the flow rate. Then, in the first embodiment, when the heat exchanger functions as an evaporator, the paths are branched (merged when the heat exchanger functions as a condenser) in the middle of the lower portion (lower heat exchanging portion HE2) of the heat exchanger 30A, to decrease the flow rate in the region where the gas is dominant (upper heat exchanging portion HE1) so as to prevent the pressure loss from increasing.

Figure 3:
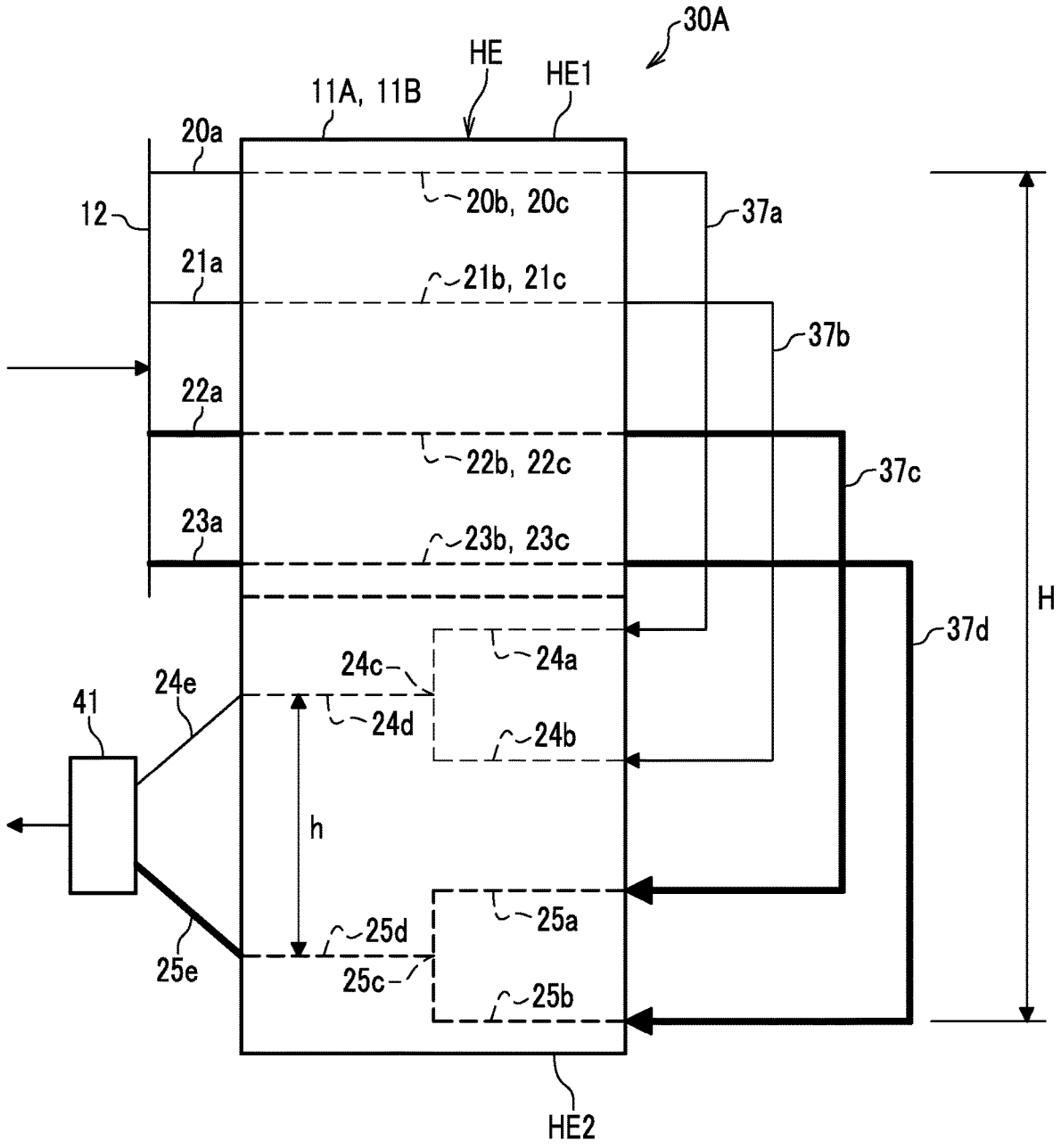
FIG. 3 is a schematic diagram showing paths in the heat exchanger of the first embodiment.

Effects to reduce the influence by gravity in the paths constructed as above will be described with reference to FIG. 3. FIG. 3 is a schematic diagram showing the paths in the heat exchanger according to the first embodiment of the present invention.

As shown in FIG. 3, the heat exchanger 30A is virtually divided into a plurality of regions, and the paths direct the refrigerant through the respective regions of the divided heat exchanging portions sequentially. That is, the paths direct the refrigerant through the upper portion (upper heat exchanging portion HE1) of the heat exchanger 30A to the lower portion (lower heat exchanging portion HE2) of the heat exchanger 30A. The refrigerant flows into the heat exchanger 30A with gas density ρV and flows out of the heat exchanger 30A with liquid density ρL. It should be noted that, in a case where the heat exchanger is not divided into upper and lower portions (for example, see FIG. 11A), the refrigerant receives the influence by gravity (pressure difference) expressed in the following equation (1) as a difference between the upper path and the lower path.

$$\Delta p0=(\rho L-\rho V)\cdot g\cdot H \quad (1)$$

(where H≈height of the heat exchanger and g is gravitational acceleration)

For a normal refrigerant, the following equation (2) is obtained if the gas density is ignored since ρV<<ρL.

$$\Delta p0=\rho L\cdot g\cdot H \quad (2)$$

Meanwhile, in the first embodiment, outlets for the refrigerant are merged on the lower portion (lower heat exchanging portion HE2) of the heat exchanger 30A, to reduce the difference in height which causes the influence by gravity. The influence by gravity (pressure difference) Δp1 in the following equation (3) is caused by the difference between the upper and lower paths.

$$\Delta p1=\rho L\cdot g\cdot h \quad (3)$$

It should be noted that the "h" in the equation (3) can be expressed by a difference in height between the highest path (heat transfer pipe 24*e*) and the lowest path (heat transfer pipe 25*e*) in the vertical direction. The difference in height "h" is set half or less (equal to or less than half) of the height "H" of the heat exchanger 30A (actually, the height slightly lower than that of the heat exchanger 30A). Therefore, the relationship between the equations (2) and (3) results in the following equation (4).

$$\Delta p1\leq\Delta p0/2 \quad (4)$$

Thus, in the first embodiment, the influence by gravity can be reduced to half or less. Further, as described above, the paths are branched in the middle of the lower heat exchanging portion HE2, when the heat exchanger 30A functions as an evaporator, allowing the flow rate to be decreased in the region where the gas is dominant so as to prevent the pressure loss from increasing. Still further, when the heat exchanger 30A functions as a condenser, the number of paths decreases to allow the difference in height "h" between the highest path and the lowest path in the vertical direction to be further reduced with the outlets for the refrigerant being merged. The above difference in height "h" can be reduced less than half with respect to the difference in height between the highest path and the lowest path at the inlets for the refrigerant on the gas side.

In addition, in the first embodiment, the plurality of connecting pipes 37*a*, 37*b*, 37*c*, 37*d* which connect the upper heat exchanging portion HE1 to the lower heat exchanging portion HE2 are arranged while keeping the order in height thereof in the vertical direction, so that they do not cross one another, allowing the heat exchanger 30A to be easily manufactured.

Second Embodiment

Figure 4:
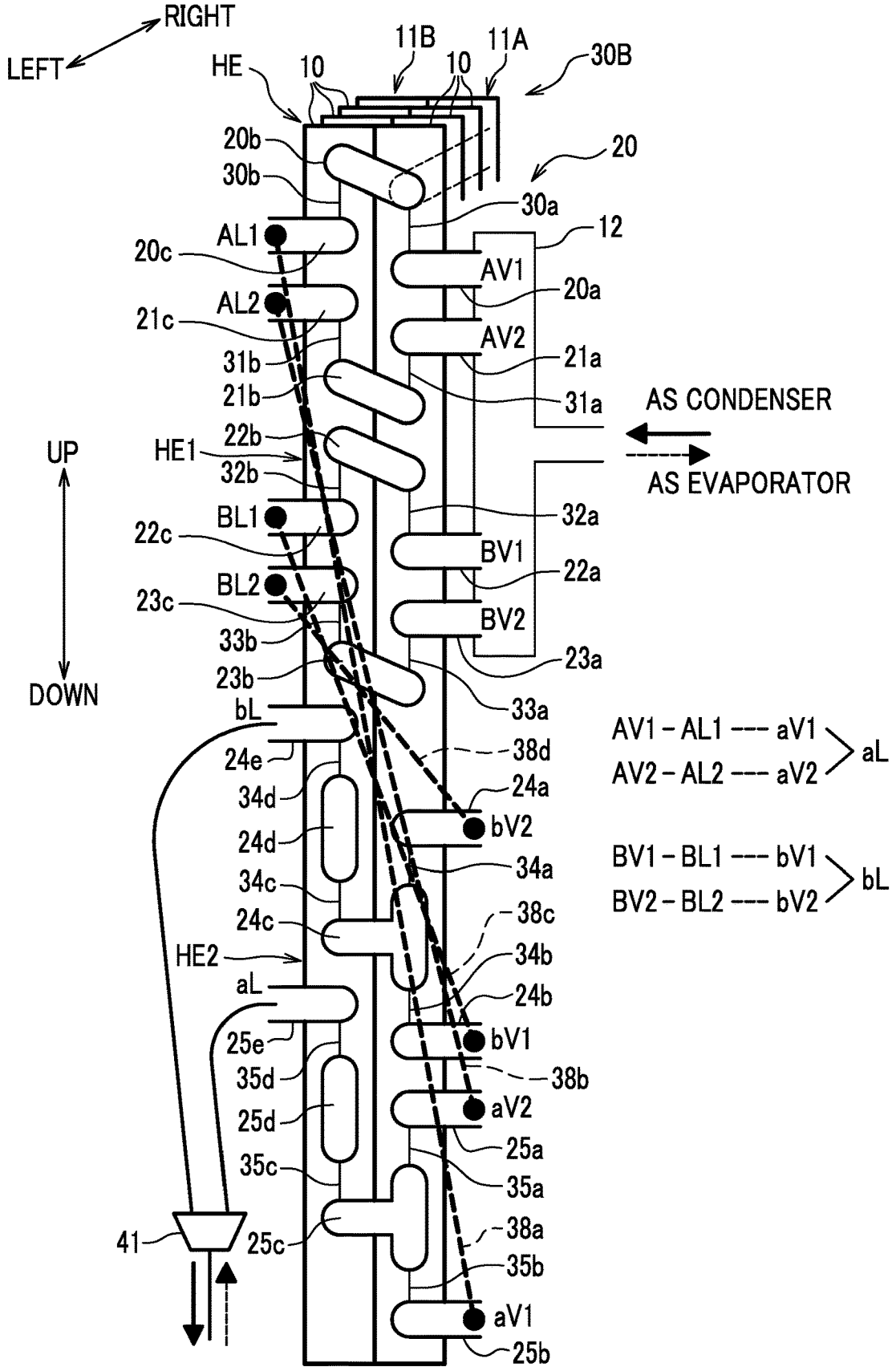
FIG. 4 is a flow diagram of a refrigerant in a heat exchanger of a second embodiment.
Figure 5:
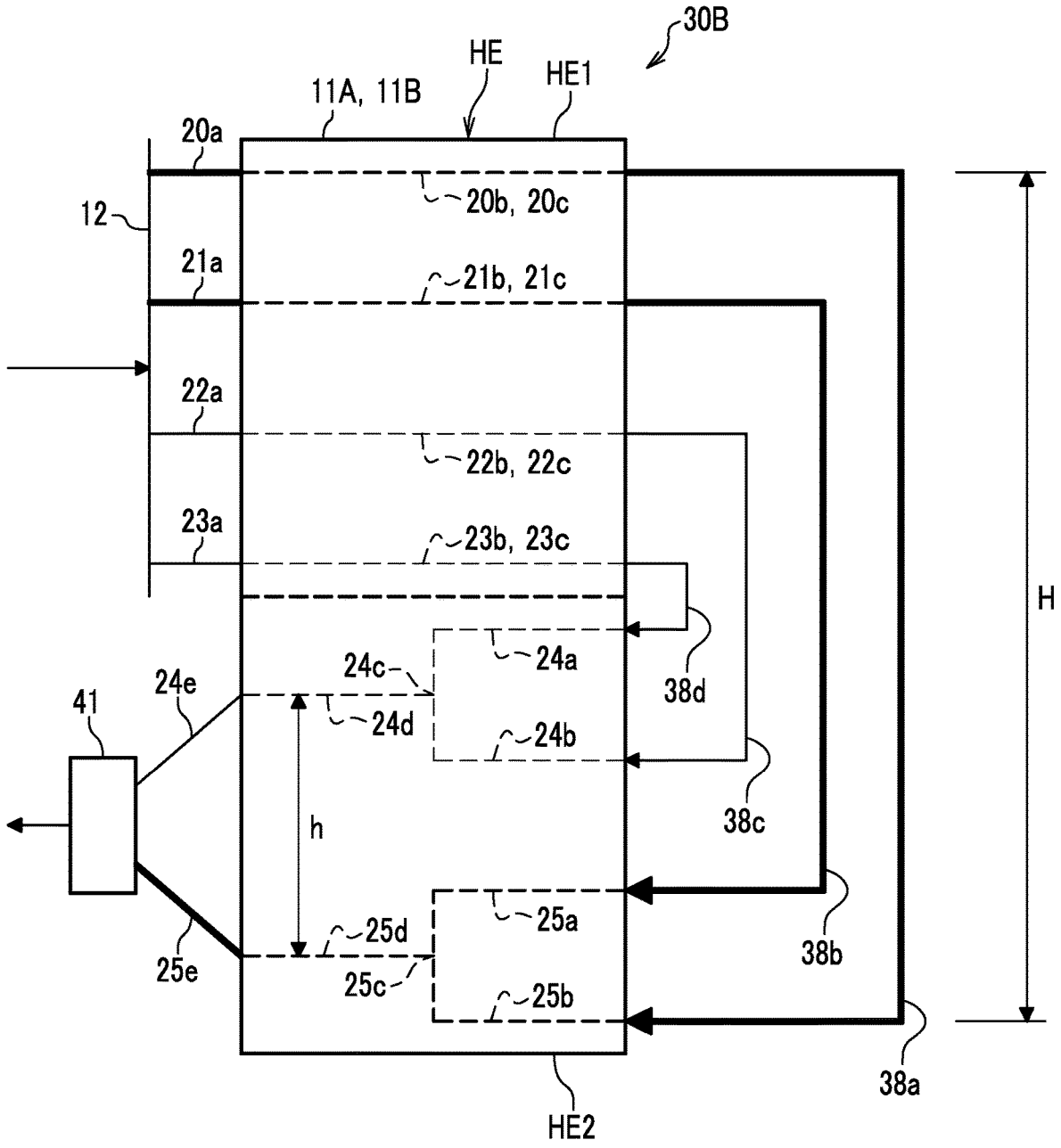
FIG. 5 is a schematic diagram showing paths in the heat exchanger of the second embodiment.

FIG. 4 is a flow diagram of the refrigerant in a heat exchanger of a second embodiment, and FIG. 5 is a schematic diagram showing paths in the heat exchanger of the second embodiment. It should be noted that, in the second embodiment, common members as those in the first embodiment are marked with the same reference numerals and duplicate descriptions thereof are omitted (the same is applied to other embodiments).

As shown in FIG. 4, a heat exchanger 30B of the second embodiment includes connecting pipes 38*a*, 38*b*, 38*c* and 38*d* in place of the connecting pipes 37*a*, 37*b*, 37*c* and 37*d* of the first embodiment.

The connecting pipe 38*a* connects the heat transfer pipe 20*c* to the heat transfer pipe 25*b*, outside the fin plates 11A, 11B. The connecting pipe 38*b* connects the heat transfer pipe 21*c* to the heat transfer pipe 25*a*, outside the fin plates 11A, 11B. The connecting pipe 38*c* connects the heat transfer pipe 22*c* to the heat transfer pipe 24*b*, outside the fin plates 11A, 11B. The connecting pipe 38*d* connects the heat transfer pipe 23*c* to the heat transfer pipe 24*a*, outside the fin plates 11A, 11B. Thus, in the second embodiment, the connecting pipes 38*a*, 38*b*, 38*c* and 38*d* are connected so that their orders in height in the vertical direction are changed.

As shown in FIG. 5, in the second embodiment, the connecting pipe 38*a* connects the highest path (heat transfer pipe 20*c*) in the upper heat exchanging portion HE1 to the lowest path (heat transfer pipe 25*b*) in the lower heat exchanging portion HE2. It should be noted that, in the second embodiment, the influence by gravity at the outlet side is the same as that in the first embodiment, but, on the connecting side (where the connecting pipes 38*a*, 38*b*, 38*c* and 38*d* are connected), the refrigerant easily flow through the upper path (heat transfer pipe 20*a*) in the upper heat exchanging portion HE1, and at the outlet side, the refrigerant is less easily flow through the lower path (heat transfer pipe 25*e*) in the lower heat exchanging portion HE2, which neutralizes each other's influence. At the connecting portion (connecting pipe 38*a*), the difference in height in the vertical direction between the upper path and the lower path is approximately "H", and, because the refrigerant is in a gas-liquid two-phase state, its density to be influenced by gravity is smaller than the liquid density.

With a void fraction α as an occupied volume ratio of gas, the influence by gravity in the upper and lower paths connected by the connecting pipe 38*a* is expressed in the following equation (5).

$$\Delta pc=\rho L\cdot(1-\alpha)\cdot g\cdot H+\rho V\cdot\alpha\cdot g\cdot H \quad (5)$$

Because the gas density is much smaller than the liquid density, if the gas density is omitted, the following equation (6) is obtained.

$$\Delta pc=\rho L\cdot(1-\alpha)\cdot g\cdot H \quad (6)$$

The dryness as a mass flow ratio of the gas-liquid at the connecting portion has correlation with the void fraction and is set to 0.2 to 0.5, which results in the void fraction α of 0.5 to 0.7 approximately. As a result, the influence by gravity is expressed as the difference at the outlet (first embodiment) and the following equation (7) is obtained.

$$\Delta p2=\Delta p1-\Delta pc=\rho L\cdot g\cdot\{h-(1-\alpha)\cdot H\} \quad (7)$$

Since h≈H/2 and α=0.5 to 0.7, Δp2 is smaller than Δp0. If h=H/2 and α=0.6 are substituted, the following equation (8) is obtained.

$$\Delta p2'=0.1\cdot\rho L\cdot g\cdot H=0.1\Delta p0 \quad (8)$$

Thus, the influence by gravity is reduced to approximately 10% of the conventional method (Δp0).

Figure 11A:
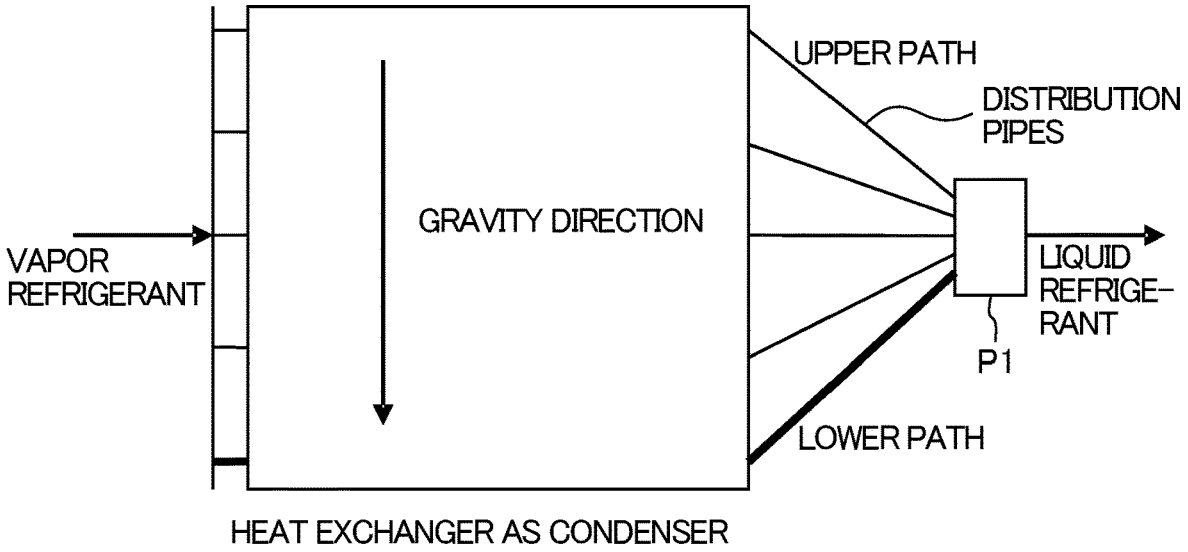
FIG. 11A is a schematic diagram showing a heat exchanger in a related art.
Figure 11B:
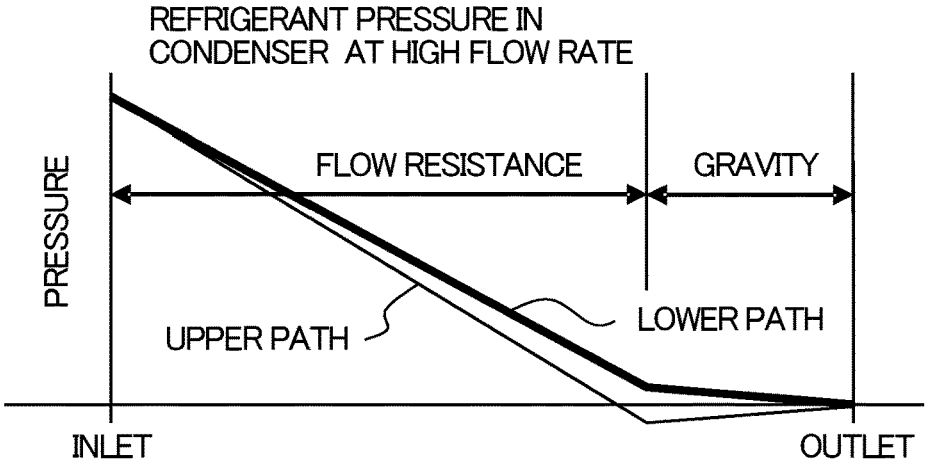
FIG. 11B is a chart showing refrigeration pressure influenced by gravity at a high flow rate.
Figure 11C:
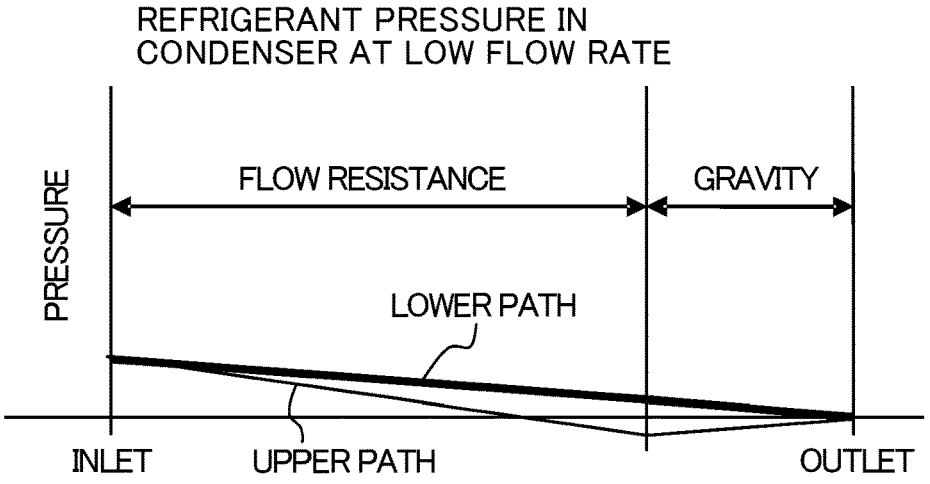
FIG. 11C is a chart showing refrigeration pressure influenced by gravity at a low flow rate.

According to the second embodiment, the influence by gravity can be made smaller than that in the first embodiment and can be reduced to approximately 10% in comparison with the conventional method (FIG. 11A). Further, as with the first embodiment, the path is branched (the branching/merging pipes 24*c*, 25*c*) in the middle of the lower heat exchanging portion HE2 to prevent the pressure loss from increasing.

Third Embodiment

Figure 6:
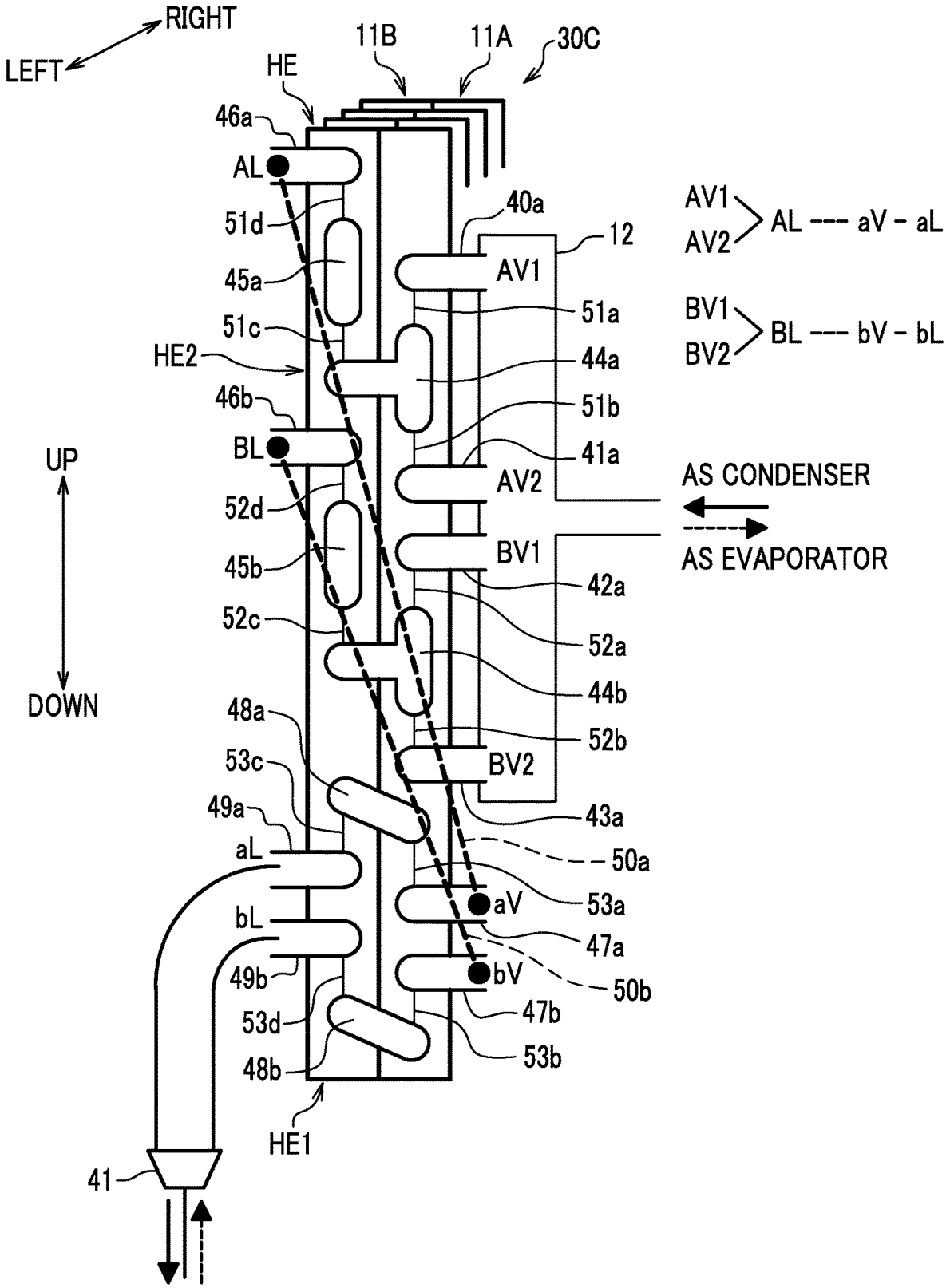
FIG. 6 is a flow diagram of a refrigerant in a heat exchanger of a third embodiment.
Figure 7:
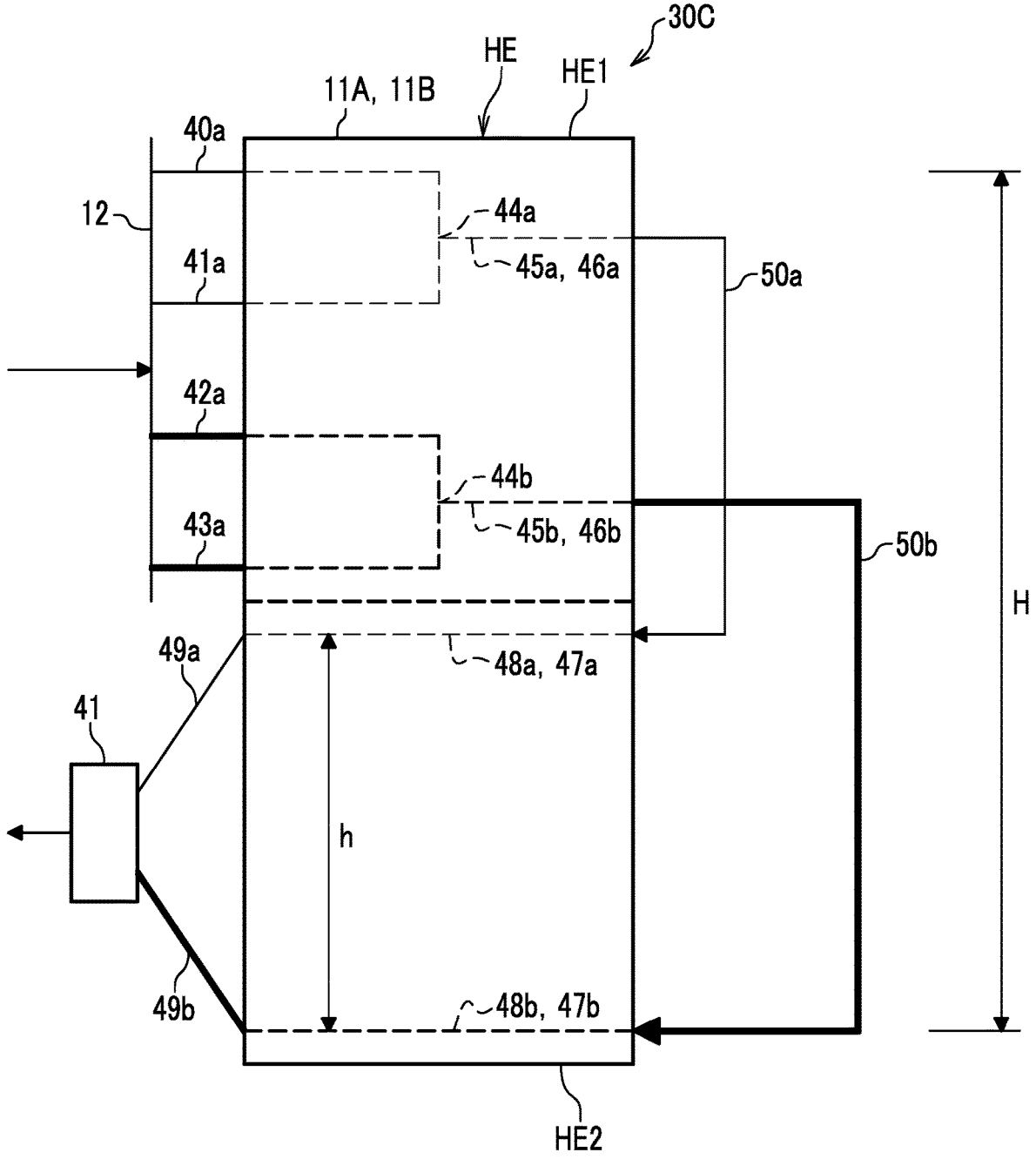
FIG. 7 is a schematic diagram showing paths in the heat exchanger of the third embodiment.

FIG. 6 is a flow diagram of the refrigerant in a heat exchanger of a third embodiment according to the present invention, and FIG. 7 is a schematic diagram showing paths in the heat exchanger of the third embodiment. It should be noted that a heat exchanger 30C in the third embodiment includes branching/merging pipes 44*a*, 44*b* arranged in the upper heat exchanging portion HE1, in place of the branching/merging pipes 24*c*, 25*c* in the lower heat exchanging portion HE2 as in the heat exchanger 30A in the first embodiment.

As shown in FIG. 6, the heat exchanger 30C includes a header 12 which is connected with four heat transfer pipes 40*a*, 41*a*, 42*a* and 43*a* and is connected to one end (left end in FIG. 6) of a fin plate 11A. It should be noted that the header 12 functions as a distributor when the heat exchanger 30C functions as a condenser, and functions as a merging device when the heat exchanger 30C functions as an evaporator.

The heat exchanger 30C includes heat transfer pipes 40*a*, 41*a*, 42*a*, 43*a*, branching/merging pipes 44*a*, 44*b*, heat transfer pipes 45*a*, 45*b*, 46*a*, 46*b*, 47*a*, 47*b*, 48*a*, 48*b*, 49*a*, 49*b*.

The heat transfer pipe 40*a* penetrates the fin plate 11A from one end to the other end to connect to one end of a return bend 51*a*. The heat transfer pipe 41*a* penetrates the fin plate 11A from one end to the other end to connect to one end of a return bend 51*b*.

The branching/merging pipe 44*a* has a three-forked shape, is positioned between the heat transfer pipe 40*a* and the heat transfer pipe 41*a*, and two pipes of the branching/merging pipe 44*a* penetrate the fin plate 11A from one end to the other end to connect to the other ends of the return bends 51*a*, 51*b*. In addition, the remaining one pipe of the branching/merging pipe 44*a* penetrates the fin plate 11B from one end to the other end of to connect to one end of a return bend 51*c*.

The heat transfer pipe 45*a* has a U-shape, penetrates the fin plate 11B from one end to the other end to connect to the other end of the return bend 51*c* and one end of a return bend 51*d*. The heat transfer pipe 46*a* penetrates the fin plate 11B from one end to the other end to connect to the other end of the return bend 51*d*.

The heat transfer pipe 42*a* penetrates the fin plate 11A from one end to the other end to connect to one end of a return bend 52*a*. The heat transfer pipe 43*a* penetrates the fin plate 11A from one end to the other end to connect to one end of a return bend 52*b*.

The branching/merging pipe 44*b* has a three-forked shape, is positioned between the heat transfer pipe 42*a* and the heat transfer pipe 43*a*, and two pipes of the branching/merging pipe 44*b* penetrate the fin plate 11A from one end to the other end to connect to the other ends of the return bends 52*a*, 52*b*. In addition, the remaining one pipe of the branching/merging pipe 44*b* penetrates the fin plate 11B from one end to the other end to connect to one end of a return bend 52*c*.

The heat transfer pipe 45*b* has a U-shape, penetrates the fin plate 11B from one end to the other end to connect to the other end of the return bend 52*c* and one end of a return bend 52*d*. The heat transfer pipe 46*b* penetrates the fin plate 11B from one end to the other end to connect to the other end of the return bend 52*d*.

The heat transfer pipe 47*a* is positioned below the heat transfer pipe 43*a*, penetrates the fin plate 11A from one end to the other end to connect to one end of a return bend 53*a*. The heat transfer pipe 48*a* is positioned above the heat transfer pipe 47*a* and is arranged to cross over the fin plates 11A, 11B. One end of the heat transfer pipe 48*a* is connected to the other end of the return bend 53*a* and the other end is connected to one end of a return bend 53*c*. The heat transfer pipe 49*a* is positioned below the heat transfer pipe 48*a*, penetrates the fin plate 11B from one end to the other end to connect to the other end of the return bend 53*c*.

The heat transfer pipe 47*b* is positioned below the heat transfer pipe 47*a*, penetrates the fin plate 11A from one end to the other end to connect to one end of a return bend 53*b*. The heat transfer pipe 48*b* is positioned below the heat transfer pipe 47*b* and is arranged to cross over the fin plates 11A, 11B. One end of the heat transfer pipe 48*b* is connected to the other end of the return bend 53*b* and the other end is connected to one end of a return bend 53*d*. The heat transfer pipe 49*b* is positioned above the heat transfer pipe 48*b*, penetrates the fin plate 11B from one end to the other end to connect to the other end of the return bend 53*d*.

In addition, the heat transfer pipe 46*a* is connected to the heat transfer pipe 47*a* via a connecting pipe 50*a*. The heat transfer pipe 46*b* is connected to the heat transfer pipe 47*b* via a connecting pipe 50*b*.

As shown in FIG. 7, the branching/merging pipes 44*a*, 44*b* are arranged in the upper heat exchanging portion HE1 (on the upstream side of the connecting pipe 50*a*). Accordingly, when functioning as a condenser, the heat exchanger 30C has four paths on the inlet side, two paths on the upstream side of a connection (connecting pipes 50*a*, 50*b*), two paths in the lower heat exchanging portion HE2 (downstream of the connection), and two paths on the outlet side. Thus, the heat exchanger 30C mostly has two paths.

The number of paths is decreased for allowing the flow rate of the refrigerant to be faster, and the faster flow rate increases thermal conductivity of the refrigerant to improve heat transfer performance. Further, the number of pipes (connecting pipes 50*a*, 50*b*) for connection between the upper path and the lower path of the heat exchanger 30C is decreased, to facilitate manufacturing the heat exchanger 30C.

Fourth Embodiment

Figure 8:
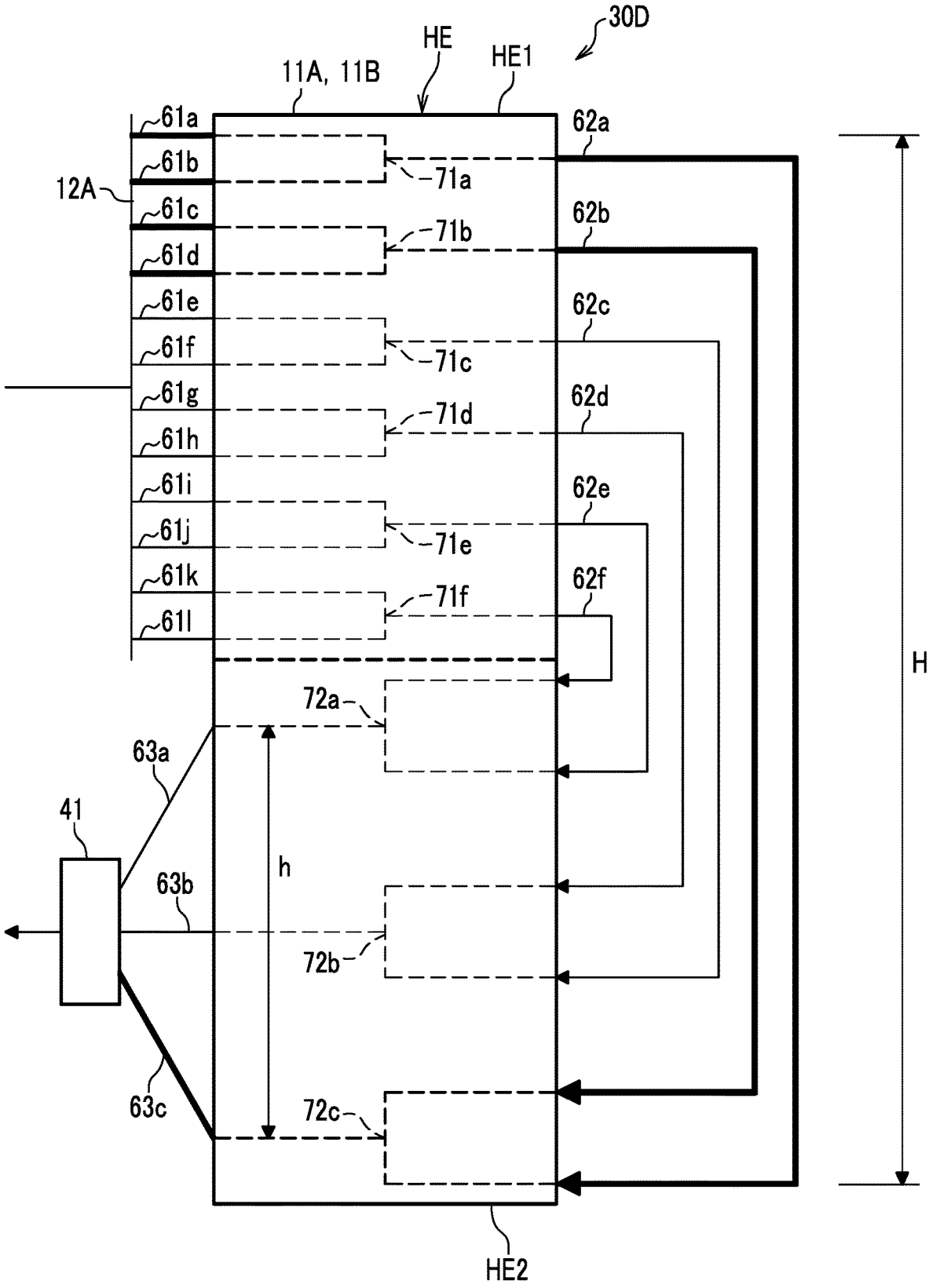
FIG. 8 is a schematic diagram showing paths in a heat exchanger of a fourth embodiment.

FIG. 8 is a schematic diagram showing paths of a heat exchanger according to a fourth embodiment of the present invention. It should be noted that, for the fourth embodiment, a drawing similar to FIG. 2, 4 or 6 is omitted. A heat exchanger 30D of the fourth embodiment has a combined structure of the first and third embodiments.

As shown in FIG. 8, the heat exchanger 30D has a header 12A connected with twelve heat transfer pipes 61*a*, 61*b*, 61*c*, 61*d*, 61*e*, 61*f*, 61*g*, 61*h*, 61*i*, 61*j*, 61*k*, 61*l*, and is connected to one end of the fin plate 11A. It should be noted that, in FIG. 8, refrigerant flow is shown when the heat exchanger 30D functions as a condenser.

Further, the heat exchanger 30D is configured such that six paths are branched to twelve paths by branching/merging portions 71*a*, 71*b*, 71*c*, 71*d*, 71*e*, 71*f* (corresponding to the branching/merging pipes 44*a*, 44*b* in FIG. 6) in the upper heat exchanging portion HE1, when the heat exchanger 30D functions as an evaporator. The upper heat exchanging portion HE1 is connected to the lower heat exchanging portion HE2 via connecting pipes 62*a*, 62*b*, 62*c*, 62*d*, 62*e*, 62*f*. In addition, the heat exchanger 30D is configured such that three paths are branched to six paths by branching/merging portions 72*a*, 72*b*, 72*c* (corresponding to the branching/merging pipes 24*c*, 25*c* in FIG. 2) in the lower heat exchanging portion HE2, when the heat exchanger 30D functions as an evaporator.

Still further, the heat exchanger 30D is set to have the difference in height "h" between the highest path (heat transfer pipe 63*a*) and the lowest path (heat transfer pipe 63*c*) in the vertical direction among the plurality of paths (heat transfer pipes 63*a*, 63*b*, 63*c*) flowing out of the lower heat exchanging portion HE2 equal to or less than half of the height "H" of the heat exchanger HE. The fourth embodiment can obtain the same effects as those of the first and third embodiments.

In addition, the heat exchanger 30D includes the branching/merging pipes 71*a* to 71*f*, 72*a* to 72*c* arranged in the respective heat exchanging portions HE1, HE2, which can double the branching effects by the branching/merging portions described in the third embodiment. That is, when the heat exchanger functions as a condenser, the refrigerant flows from the header 12A as vapor (gas) and flows out of the heat transfer pipes 63*a*, 63*b*, 63*c* as liquid. In this case, gas flows faster to have resistance increased. To prevent the resistance from being increased, the gas flow is branched by the branching/merging pipes 71*a* to 71*f*, 72*a* to 72*c* to reduce the resistance on the gas side. On the other hand, since the resistance decreases on the liquid side (on the outlet side when the heat exchanger functions as a condenser), the flow rate of the liquid is desirably increased to increase heat transfer rate. The liquid side is desirably to have as few branches as possible while the gas side is desirably to have as many branches as possible. In the third embodiment (see the thick solid lines in FIG. 7), the liquid side (heat transfer pipe 49*a*) has one path while the gas side (heat transfer pipes 42*a*, 43*a*) has two paths, and in the fourth embodiment (see the thick solid lines in FIG. 8), the liquid side (the heat transfer pipe 63*c*) has one path while the gas side (heat transfer pipes 61*a* to 61*d*) has four paths.

Thus, the paths are branched (branching/merging pipes 71*a* to 71*f*, 72*a* to 72*c*) in the middle of the upper and lower heat exchanging portions HE1, HE2, further preventing the pressure loss from increasing in comparison with the third embodiment when the heat exchanger 30D is used as an evaporator. In addition, when the heat exchanger 30D is used as a condenser, the number of paths is decreased for the refrigerant (liquid) to flow faster. With the faster flow, a heat transfer rate of the refrigerant increases to improve heat transfer performance. In addition, the number of paths is decreased more than that in other embodiments to allow for making the difference in height "h" between paths through which the refrigerant outflows smaller.

Fifth Embodiment

Figure 9:
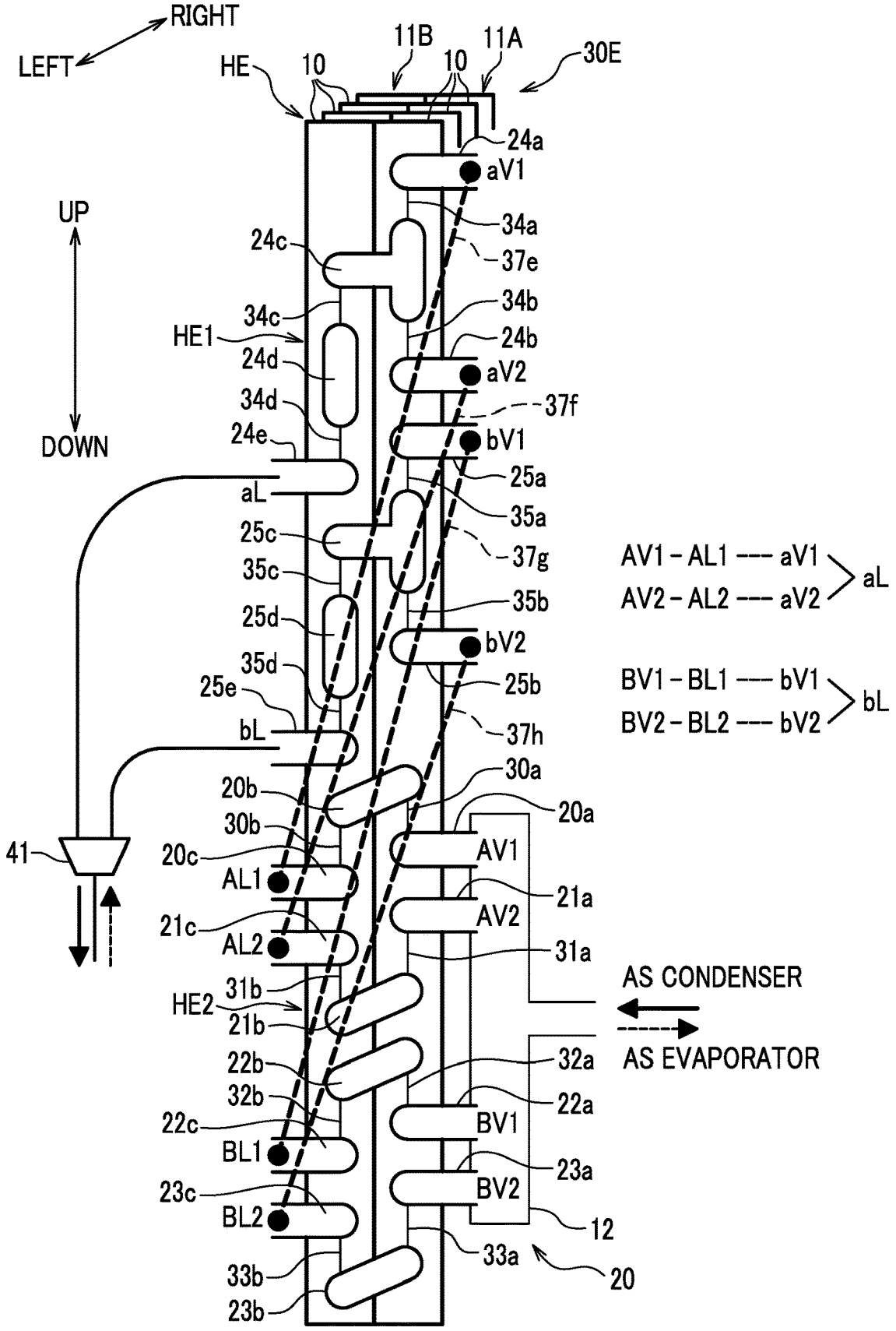
FIG. 9 is a flow diagram of a refrigerant in a heat exchanger of a fifth embodiment.
Figure 10:
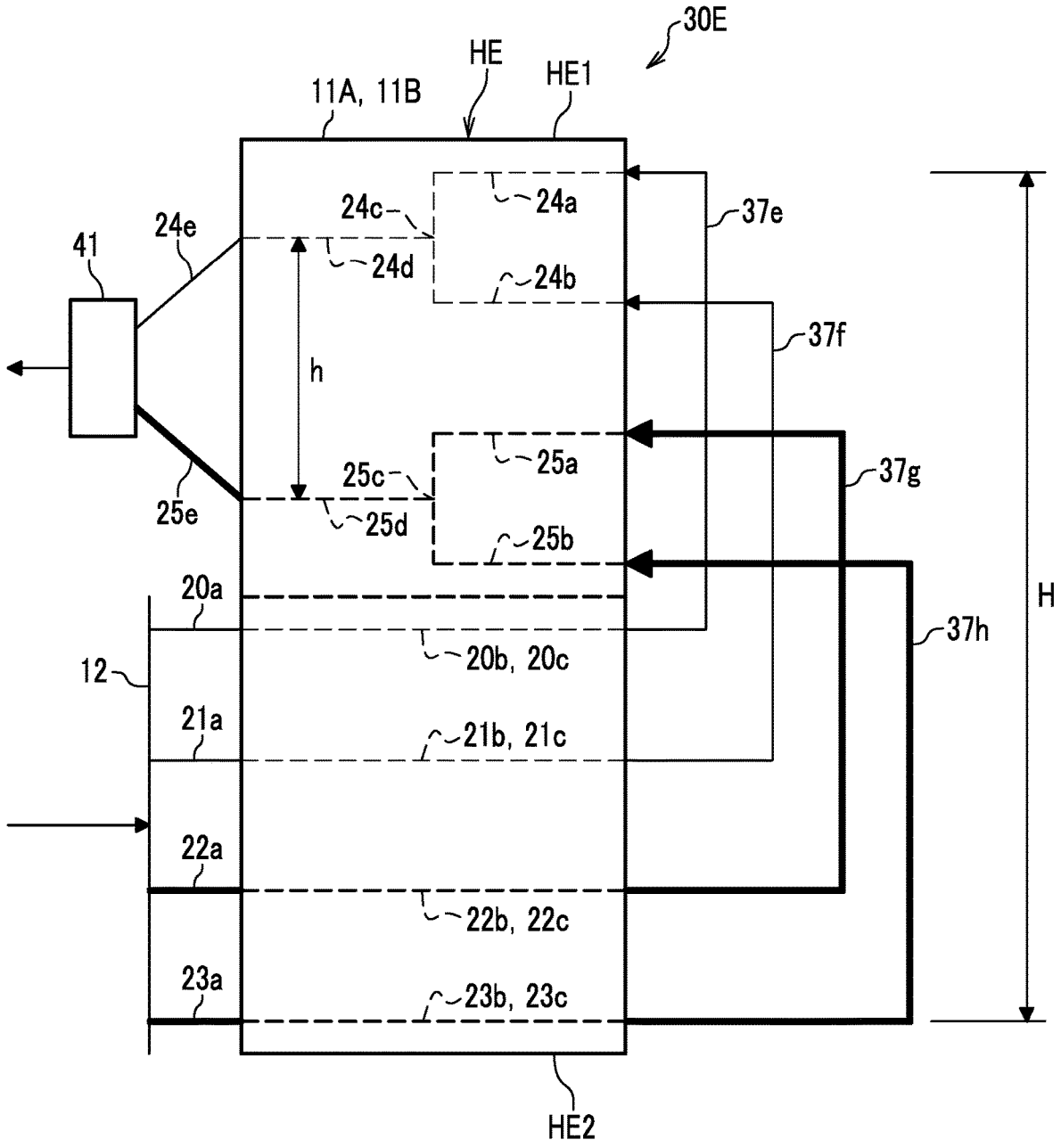
FIG. 10 is a schematic diagram showing paths in a heat exchanger of the fifth embodiment.

FIG. 9 is a flow diagram of the refrigerant in a heat exchanger of a fifth embodiment, and FIG. 10 is a schematic diagram showing paths in the heat exchanger of the fifth embodiment. A heat exchanger 30E in the fifth embodiment has an upside-down structure of an input and an output for the refrigerant with respect to the heat exchanger 30A of the first embodiment.

As shown in FIG. 9, the heat exchanger 30E includes the header 12, heat transfer pipes 20*a* to 20*c*, 21*a* to 21*c*, 22*a* to 22*c*, 23*a* to 23*c* at a lower portion of the heat exchanger 30E, and includes heat transfer pipes 24*a*, 24*b*, 25*a*, 25*b*, branching/merging pipes 24*c*, 25*c*, and heat transfer pipes 24*d*, 24*e*, 25*d*, 25*e* at an upper portion of the heat exchanger 30E.

In addition, the heat transfer pipe 20*c* is connected to the heat transfer pipe 24*a* via a connecting pipe 37*e*. The heat transfer pipe 21*c* is connected to the heat transfer pipe 24*b* via a connecting pipe 37*f*. The heat transfer pipe 22*c* is connected to the heat transfer pipe 25*a* via a connecting pipe 37*g*. The heat transfer pipe 23*c* is connected to the heat transfer pipe 25*b* via a connecting pipe 37*h*.

As shown in FIG. 10, when the heat exchanger 30E functions as a condenser, the difference in height "h"

between the highest path (heat transfer pipe 24*e*) and the lowest path (heat transfer pipe 25*e*) in the vertical direction on the outlet side for the refrigerant is set at half or less (equal to or less than half) of the height "H" of the heat exchanger 30E (actually, a height slightly lower than that of the heat exchanger 30E).

Thus, the fifth embodiment can reduce the influence by gravity to half or less, as with the first embodiment. In addition, as described above, when the heat exchanger functions as an evaporator, the paths are branched in the middle of the upper heat exchanging portion HE1 to decrease the flow rate in a region where gas is dominant (lower heat exchanging portion HE2) for preventing the pressure loss from increasing.

Further, in the fifth embodiment, the plurality of connecting pipes 37*e*, 37*f*, 37*g*, 37*h*, which connect the lower heat exchanging portion HE2 to the upper heat exchanging portion HE1, are connected while keeping the order in height in the vertical direction, that is, the connecting pipes 37*e*, 37*f*, 37*g*, 37*h* do not cross with one another, to facilitate manufacturing the heat exchanger 30E.

In a case where a heat exchanger is used in an outdoor unit, frost may adhere to the heat exchanger depending on a condition during heating operation (the heat exchanger functions as an evaporator). An operation for defrosting is normally performed by switching to a cooling cycle to operate the heat exchanger as a condenser, so as to introduce refrigerant having high temperature into the heat exchanger. In this case, the frost adhered to a lower portion of the heat exchanger is desirably defrosted as soon as possible because the frost blocks the defrosted water from being discharged. In the fifth embodiment, at the time of defrosting, the heat exchanger used as an evaporator is switched to be used as a condenser to introduce refrigerant from the lower portion (lower heat exchanging portion HE2) of the heat exchanger 30E, resulting in that hot refrigerant first flows into the lower portion of the heat exchanger 30E and the frost adhered to the lower portion of the heat exchanger 30E can be defrosted faster than that adhered on the upper portion, so that the defrosted water can flow freely.

It should be noted that the present invention is not limited to the embodiments described above and can be variously modified within the scope of the present invention. For example, two or more of the first to fifth embodiments may be suitably combined for application.

What is claimed is:

1. A heat exchanger comprising:

a heat exchanging portion including (i) a plurality of first paths and a plurality of second paths through which a refrigerant flows, the plurality of first paths each having one end connected to a header outside the heat exchanging portion and another end connected to one of the plurality of second paths, and (ii) a plurality of columns of fin plates that exchange heat between the refrigerant and air and through which the plurality of first paths and the plurality of second paths penetrate, wherein each of the plurality of first paths extends from the header and enters the heat exchanging portion at a position higher than all portions of all of the plurality of second paths or at a position lower than all portions of all of the plurality of second paths, when the heat exchanging portion functions as a condenser, the refrigerant is flown from the header into the heat exchanging portion via the plurality of first paths, the plurality of first paths are reduced in number into the plurality of second paths, every two paths of the plurality of first paths merge into a respective single one of the plurality of second paths after the refrigerant has flown through at least a first one of the columns of fin plate, and the respective single one of the plurality of second paths flows the refrigerant through at least a second one of the columns of fin plate, the plurality of second paths flow the refrigerant out of the heat exchanging portion, and a difference in height between a highest portion and a lowest portion in a vertical direction among the plurality of second paths is equal to or less than half of a height of the heat exchanging portion.

2. The heat exchanger according to claim 1, wherein the plurality of first paths flow the refrigerant from one of the columns of fin plate to another one of the columns of fin plate while keeping an order of height in the vertical direction.

3. The heat exchanger according to claim 1, wherein the plurality of first paths flow the refrigerant from one of the columns of fin plate to another one of the columns of fin plate while changing an order of height in the vertical direction.

4. The heat exchanger according to claim 1, wherein, when each of the plurality of first paths extends from the header and enters the heat exchanging portion at a position higher than all of the plurality of second paths, the plurality of first paths flow the refrigerant out from an upper portion and into a lower portion of the heat exchanging portion, and when each of the plurality of first paths extends from the header and enters the heat exchanging portion at a position lower than all of the plurality of second paths, the plurality of first paths flow the refrigerant out from a lower portion and into a higher portion of the heat exchanging portion.

5. A heat exchanger comprising:

a heat exchanging portion including (i) a plurality of first paths and a plurality of second paths through which a refrigerant flows, the plurality of first paths each having one end connected to a header outside the heat exchanging portion and another end connected to one of the plurality of second paths, and (ii) a plurality of columns of fin plates that exchange heat between the refrigerant and air and through which the plurality of first paths and the plurality of second paths penetrate, wherein each of the plurality of first paths extends from the header and enters the heat exchanging portion at a position higher than all portions of all of the plurality of second paths, the heat exchanging portion is divided into a plurality of regions in which the plurality of first paths and the plurality of second paths are configured to flow the refrigerant through sequentially, when the heat exchanging portion functions as a condenser, the refrigerant is flown into a highest one of the regions via the plurality of first paths, and the refrigerant flows out of a lowest one of the regions via the plurality of second paths, the plurality of first paths are reduced in number into the plurality of second paths in the lowest one of the regions, a difference in height between a highest portion and a lowest portion in a vertical direction among the plurality of second paths is set equal to or less than half of a height of the heat exchanging portion.

6. The heat exchanger according to claim 5, wherein the plurality of first paths flow the refrigerant out from the highest one of the regions and into the lowest one of the regions of the heat exchanging portion.

7. A heat exchanger comprising:

a heat exchanging portion including (i) a plurality of first paths and a plurality of second paths, through which a refrigerant flows, the plurality of first paths each having one end connected to a header outside the heat exchanging portion and another end connected to one of the plurality of second paths, and (ii) a plurality of columns of fin plates that exchange heat between the refrigerant and air and through which the plurality of first paths and the plurality of second paths penetrate, wherein each of the plurality of first paths extends from the header and enters the heat exchanging portion at a position lower than all portions of all of the plurality of second paths, the heat exchanging portion is divided into a plurality of regions in which the plurality of first paths and the plurality of second paths are configured to flow the refrigerant through sequentially, when the heat exchanging portion functions as a condenser, the refrigerant is flown into a lowest one of the regions via the plurality of first paths, and the refrigerant flows out of a highest one of the regions via the plurality of second paths, the plurality of first paths are reduced in number into the plurality of second paths in the highest one of the regions, a difference in height between a highest portion and a lowest portion in a vertical direction among the plurality of second paths is set equal to or less than half of a height of the heat exchanging portion.

8. The heat exchanger according to claim 7, wherein the plurality of first paths flow the refrigerant out from the lowest one of the regions and into the highest one of the regions of the heat exchanging portion.

* * * * *